US005080811A

United States Patent [19]

Brueckmann et al.

[11] Patent Number: 5,080,811

[45] Date of Patent: Jan. 14, 1992

[54] ETHOXYLATED FATTY ACID AMIDE TEXTILE SOFTENERS

[75] Inventors: Ralf Brueckmann, Goennheim; Toni Simenc, Mannheim, both of Fed. Rep. of Germany

[73] Assignee: BASF Aktiengesellschaft, Ludwigshafen, Fed. Rep. of Germany

[21] Appl. No.: 575,623

[22] Filed: Aug. 31, 1990

[30] Foreign Application Priority Data

Sep. 1, 1989 [DE] Fed. Rep. of Germany ..... 3928978

[51] Int. Cl.[5] ..... C11M 10/08

[52] U.S. Cl. ..... 252/8.6; 252/8.8; 252/544

[58] Field of Search ..... 252/8.8, 8.6, 544

[56] References Cited

U.S. PATENT DOCUMENTS

| | | | |
|---|---|---|---|
| 2,520,381 | 8/1950 | Carnes . | |
| 4,685,930 | 8/1987 | Kasprzak | 252/8.8 |
| 4,818,248 | 4/1989 | Back et al. | 252/8.9 |
| 4,921,622 | 5/1990 | Kato et al. | 252/8.9 |

FOREIGN PATENT DOCUMENTS 2136673 2/1973 Fed. Rep. of Germany .

*Primary Examiner*—Paul Lieberman
*Assistant Examiner*—William S. Parks
*Attorney, Agent, or Firm*—Oblon, Spivak, McClelland, Maier & Neustadt

[57] ABSTRACT

Reaction products of compounds of the formula I $$RCONHC_2H_4OH \qquad I$$

where R is $C_{12}$–$C_{20}$-alkyl or -alkenyl, with 14 to 18 mol of ethylene oxide per mole of I, are useful as textile softeners.

7 Claims, No Drawings

ETHOXYLATED FATTY ACID AMIDE TEXTILE SOFTENERS

The present invention relates to the use of reaction products of compounds of the formula I $$RCONHC_2H_4OH \quad I$$

where R is $C_{12}$–$C_{20}$-alkyl or -alkenyl, preferably $C_{16}$–$C_{20}$-alkyl or -alkenyl, with from 14 to 18 mol of ethylene oxide per mole of I, as textile softeners.

The RCO radical is derived for example from lauric acid, linolenic acid, stearic acid, palmitic acid, tallow fatty acid or coco fatty acid, but preferably from oleic acid.

The compounds of the formula I are preferably reacted with 16 mol of ethylene oxide per mole of I. The compounds of the formula I are known; they can be prepared in a conventional manner, for example by reacting the acids of the formula $$RCOOH$$

with monoethanolamine.

Some of the reaction products of the compounds and ethylene oxide are likewise known, for example from U.S. Pat. No. 2,520,381.

The compounds of the formula I are advantageously reacted with ethylene oxide under superatmospheric pressure (from 2 to 10, preferably from 4 to 8, bar) at from 100° to 140° C., preferably from 110° to 120° C., a little at a time. The catalyst used is preferably potassium t-butoxide. The reaction products are then worked up in a conventional manner.

Details of the preparation are given in the Examples, in which parts and percentages are by weight, unless otherwise stated.

The reaction products of compounds I and ethylene oxide are used as softeners for textiles, preferably fabrics formed from cotton, viscose staple, polynosics or other regenerated cellulose fibers, and blends thereof with synthetic fibers, such as polyamide, polyacrylonitrile, polyester or cellulose triacetate fibers.

They produce a pleasant, soft, silky and smooth fabric hand.

The reaction products used according to the present invention are water-soluble and nonionic. These two properties are advantageous for compatibility with colorants and finishes used in the impregnating liquor, for example amino resin precondensates for crease-resist and shrink-resist finishing, dyes, pigments and binders, fluorescent whitening agents, water-repellent finishes, and leveling and wetting agents In particular, products according to the present invention which have been aftertreated in a conventional manner for brightening do not undergo yellowing on finishing.

The softeners can be applied to the textile material in any desired manner, for example by spraying or dipping and squeezing off (pad-mangling).

The amount of product used according to the present invention can be varied within wide limits as a function of the textile material to be treated, the amount of finish added, and the desired softening effect. In general, it is applied to cotton and viscose staple textiles as a permanent finish in an amount of 0.2–3% by weight, preferably 0.6–1.5% by weight, on weight of fiber.

Compared with prior art softeners based on alkoxylated fatty acids, the products used according to the present invention have better softening properties and also a stabilizing effect on silicone-based products.

Polydimethylsiloxane emulsions, as will be known, are used in textile finishing as excellent softeners and smoothing agents; they are predominantly applied to the textile material by pad-mangling (dipping, squeezing off). However, all commercial polysiloxane emulsions lack shear stability under the action of the squeeze rolls. At a high production speed, the emulsion disintegrates under the strong shearing forces of the pad-mangle rolls, causing pure silicone oil to separate from the emulsion. A coating forms on the rolls, which causes irreparable spots on the textile material.

By admixing the polysiloxane emulsions with the products used according to the present invention, it is possible to improve the shear stability to a significant degree, so that it becomes possible as a result to work at high production speeds. As regards the application properties, the mixed products give similar results to those of the pure silicone softeners alone, which are comparatively costly.

Advantageous mixtures contain for example 1–6 parts by weight of silicone emulsion (silicon content 10–12%) and 9–4 parts by weight of the reaction products used according to the present invention. Application Examples

EXAMPLE 1

A 100% cotton fabric weighing about 100 g/m² is dipped into a bath a, b or c containing

| a g/l | b g/l | c g/l | |
|---|---|---|---|
| 100 | 100 | 100 | of a 45% strength solution of N,N'-dimethylol-4,5-dihydroxyethyleneurea, |
| — | 30 | — | of the 30% strength solution of the reaction product of Example 3, |
| — | — | 30 | of the 30% strength solution of the reaction product of Example 4, |
| 15 | 15 | 15 | of $MgCl_2 \times 6\ H_2O$ and |
| 1 | 1 | 1 | of an adduct of 7 mol of ethylene oxide with 1 mol of isooctylphenol. |

is then squeezed off on the pad-mangle to a wet pickup of about 80%, dried at 110° C. and thereafter kept at 150° C. for 5 minutes to effect condensation.

The fabric finished with bath (a) has a full, rough hand, whereas fabrics finished with baths (b) and (c) are pleasantly soft, smooth and silky.

EXAMPLE 2

A 50/50 PES/Co blend fabric weighing about 90 g/m² is impregnated in runs a–d with the corresponding aqueous liquor containing

| a g/l | b g/l | c g/l | d g/l | |
|---|---|---|---|---|
| 70 | 70 | 70 | 70 | of a 45% strength solution of N,N'-dimethoxymethyl-4,5-dihydroxyethyleneurea, |
| 12 | 12 | 12 | 12 | of $MgCl_2 \times 6\ H_2O$, |
| 1 | 1 | 1 | 1 | of an adduct of 7 mol of ethylene oxide with 1 mol of isooctylphenol, |
| — | 30 | — | — | of a mixed product I, |
| — | — | 30 | — | of a mixed product II and |
| — | — | — | 30 | of a commercial 30% strength emulsion of α,ω-dihydroxypolydimethylsiloxane (Si content |

-continued

| a g/l | b g/l | c g/l | d g/l |
|---|---|---|---|
| | | | about 12%). |

then squeezed off to a wet pickup of about 70%, dried at 110° C. and kept at 150° C. for 5 minutes to effect condensation.

Mixed product I 6 parts of 30% strength aqueous solution of reaction product prepared according to Example 3 and 4 parts of 30% strength emulsion of silicone softener of run d).

Mixed product II 5 parts of 30% strength aqueous solution of reaction product prepared according to Example 4 and 5 parts of 30% strength emulsion of the same silicone softener as in run (d).

No difference in fabric hand is discernible between b, c and d. The finished fabric has the same softness in run b–d, with the smoothness typical of silicone. By contrast, the fabric treated in run (a) is harsh and rough.

To test the shear stability, the experimental liquors a–d were first stirred with a stirrer at 3000 r.p.m. for 10 minutes. Thereafter the extent of the formation of a coating on the rolls was examined as follows:

450 ml of the liquor are introduced into the trough of a pad-mangle. The pad-mangle has two horizontal rolls 9 cm in diameter and 15 cm in length. The drive is electric, via a continuously adjustable transmission system. The nip pressure is set via a lever arm 35 cm in length; a lead weight of about 12 kg hangs from the end of the lever arm. The hardness of the pad-mangle rolls is 72° Shore (drive roll) and 84° Shore (pressure roll).

An endless Co fabric 12 cm in width and 50 cm in length is passed through the liquor and upwards into the nip at about 12 m/min for 30 minutes. The extent of coating formation on the rolls is assessed visually on a scale ranging from 1 (no coating) to 5 (thick coating).

The liquors which contain the mixed products (b + c) do not produce any coating on the rolls. The surface of the rolls is smooth and clean. Liquor (a) was also rated 1. Liquor (b), however, was rated 3–4; the rolls showed distinct silicone deposits.

Preparation Examples

| | |
|---|---|
| 325 g (1 mol) | of oleic monoethanolamide are mixed in an autoclave with |
| 3.3 g (1% by weight) | of potassium tert-butoxide and |
| 0.3 g (0.1% by weight) | of phosphorous acid and reacted at 110–120° C. with |
| 740 g (16 mol) | of ethylene oxide, added a little at a time, at 5–10 bar. After the ethoxylation has ended, unconverted ethylene oxide is evaporated off at 80° C./1 mbar for 1 h (check by Preußmann test). The ethoxylate is diluted with |
| 1915 g | of water and the aqueous solution is adjusted at RT with |
| 6 g (0.07 mol) | of oxalic acid to pH 6.0. About 2960 g of a 35% strength solution are obtained. |

EXAMPLE 4

Example 3 is repeated, except that 243.3 g (1 mol) of lauric ;monoethanolamide are used. The concluding adjustment to pH 6 is effected with phosphoric acid, in contradistinction to Example 3. About 2460 g of a 40% strength solution are obtained.

We claim:

1. A method of softening fabrics which comprises:

(a) treating a fabric with the reaction product formed by condensing a compound of formula I $$RCONHC_2H_4OH$$

with 14–18 mol of ethylene oxide per mole of I, wherein R is $C_{12}$–$C_{20}$ alkyl or alkenyl; and (b) drying the treated fabric;

wherein said reaction product remains in contact with the fabric subsequent to drying.

2. The method of softening fabrics of claim 1, wherein R is derived from oleic acid.

3. The method of softening fabrics of claim 1, wherein the compound of the formula I has been reacted with 16 mol of ethylene oxide.

4. The method of softening fabrics of claim 1, wherein the reaction product is prepared from oleic ethanolamide and 16 moles of ethylene oxide.

5. A method of softening fabrics which comprises:

(a) treating a fabric with a composition comprising:

(i) the reaction product formed by condensing a compound of formula I $$RCONHC_2H_4OH$$

with 14–18 moles of ethylene oxide; and (ii) a polysiloxane emulsion wherein the silicon content is in the range of 10 to 12%; and (b) drying the treated fabric;

wherein the composition remains in contact with the fabric subsequent to drying.

6. The method of softening fabrics of claim 5 wherein the polysiloxane is polydimethylsiloxane.

7. The method of softening fabrics of claim 5 wherein the polysiloxane is α, x-dihydroxypolydimethylsiloxane.

* * * * *